United States Patent [19]

Störr

[11] 4,437,600

[45] Mar. 20, 1984

[54] CONTINUOUS WIRE FEED ARRANGEMENT FOR STAPLING APPARATUS

[75] Inventor: Rudolf Störr, Karl-Marx-Stadt, German Democratic Rep.

[73] Assignee: Veb Kombinat Polygraph "Werner Lamberz" Leipzig, German Democratic Rep.

[21] Appl. No.: 283,020

[22] Filed: Jul. 8, 1981

Related U.S. Application Data

[63] Continuation-in-part of Ser. No. 273,552, Jun. 15, 1981, abandoned.

[30] Foreign Application Priority Data

Jun. 17, 1980 [DD] German Democratic Rep. ... 221882

[51] Int. Cl.[3] ..... B65H 17/04

[52] U.S. Cl. ..... 226/108; 226/112

[58] Field of Search ..... 226/108, 109, 110, 111, 226/112; 242/56 R, 56 A, 58.1

[56] References Cited

U.S. PATENT DOCUMENTS

| | | | |
|---|---|---|---|
| 2,047,280 | 7/1936 | Melnick | 242/58.1 |
| 2,754,958 | 7/1956 | Murrell et al. | 226/110 X |
| 3,128,026 | 4/1964 | Bonnell | 226/110 X |
| 3,252,671 | 5/1966 | Phillips | 242/58.1 |
| 3,630,425 | 12/1971 | Wilkens | 226/108 |
| 3,694,620 | 9/1972 | Gleason | 226/110 X |
| 3,702,168 | 11/1972 | Roos | 226/110 |
| 4,003,527 | 1/1977 | Schulze | 242/56 R X |
| 4,346,853 | 8/1982 | Stefanoni | 242/56 R |

*Primary Examiner*—Stuart S. Levy
*Assistant Examiner*—Lloyd D. Doigan
*Attorney, Agent, or Firm*—Michael J. Striker

[57] ABSTRACT

A continuous wire feed arrangement for feeding wire to a stapling apparatus or the like comprises two nozzles respectively located along paths along which wires may be fed to a device for cutting and transmitting cut wire portions to the stapling apparatus. The wire feed is carried out at any time only to one of the nozzles. Each of the wires is withdrawn over a guide roll and a wire feed device from a wire reel. The respective fed wire closes thereby over the guide roll an electric circuit. When this circuit is interrupted due to running out of wire on one of the wire reels, or due to interruption of the feed of the one wire, the transport of the other wire is automatically initiated. The changeover of the wire transport from one to the other wire reel is carried out by electromechanical elements. In this way a continuous uninterrupted wire supply to the cutting and transmitting device is assured.

8 Claims, 2 Drawing Figures

CONTINUOUS WIRE FEED ARRANGEMENT FOR STAPLING APPARATUS

CROSS-REFERENCE TO RELATED APPLICATION

This application is a continuation-in-part application of my copending application Ser. No. 273,552, filed June 15, 1981 and entitled: NON-STOP WIRE FEEDING DEVICE FOR STAPLE DEVICES, now abandoned.

BACKGROUND OF THE INVENTION

The present invention relates to a continuous wire feed arrangement for stapling apparatus. Such wire feed arrangements are used in many applications, for instance in assembly lines for stapling booklets or in connection with rotating offset printing machines.

The German Pat. No. 756,731 discloses a device in which the stapling wire is alternately withdrawn from two reels in the form of a V fed to a common channel or nozzle. Thereby the wire is contacted by means of a feeler and at the end of the wire transport a gear unit is actuated. The gear unit, when actuated, imparts opposite movements to the transporting rolls of the exhausted reel and the replacement reel, whereby wire from the replacement reel is transmitted to the channel and the residual wire of the exhausted reel is withdrawn from the channel. A problem with this construction is the proper return movement of the residual wire and the proper introduction of the leading end of the next wire into the channel. In addition, the switching over from one to the other reel requires a relatively long time, which leads, especially at fast operating machines, to a great number of unstapled products, which have to be discarded.

A continuous wire feed mechanism for stapling apparatus is further known from the DD-PS No. 100,437. In this wire feed mechanism the stapling wire is also alternately in form of a V fed to a guide channel. The wire transport is produced by means of tiltably mounted rolls, which after exhaustion of the wire from the first reel move the wire from the second reel over a downstream arranged pair of transporting rolls to the common guide channel. The disadvantage of this construction is also a relatively large time period which expires during the changeover from the first to the second wire reel, and vice versa, and the resulting production of unstapled products.

SUMMARY OF THE INVENTION

It is an object of the present invention to provide a continuous wire feed mechanism which avoids the disadvantages of such wire feed mechanisms known in the art.

It is a further object of the present invention to provide a continuous wire feeding arrangement for wire stapling apparatus which will assure a quick and positive switching of the wire transport from one wire reel to the next wire reel and which permits also to process wires of different thickness. In addition, the continuous wire feeding arrangement according to the present invention should also assure that during any obstruction of wire feed from one reel an automatic switching over to the next reel will be produced.

With these and other objects in view, which will become apparent as the description proceeds, the continuous wire feeding arrangement of the present invention for wire stapling apparatus mainly comprises two wire supply means; two wire guide nozzles respectively arranged along paths leading from the respective wire supply means to a wire cutting and transporting device, wire feed means for respectively transporting the wires from the respective wire supply means through and beyond the respective nozzle, and means cooperating with said wire feed means for transporting, upon interruption of wire feed from one of the wire supply means to one of the nozzles, wire from the other wire supply means to and beyond the other of the nozzles so as to produce a continuous wire feed.

The mechanism includes further a guide roll of electrically conductive material and insulated from the ground arranged between each of the wire supply means and the wire feed means and forming part of an electric control circuit which upon interruption of wire feed from one wire supply means to one of the nozzles causes transport of wire from the other wire supply means to and beyond the other nozzle.

Each of the wire supply means comprises a wire reel, and the two nozzles are arranged parallel and adjacent each other, and the wire feed means comprise a pair of transversely spaced driven wire advancing rolls respectively engaging the wires passing between the respective guide roll to the respective nozzle and a driven counter roll located in the region of said pair of advancing rolls between said wires and axially shiftable between a first position pressing one of the wires against the periphery of one of the advancing rolls so as to feed said one wire and a second position pressing the other wire against the other of the advancing rolls so as to feed said other wire, and electromechanical shifting means connected to the control circuit for shifting the counter roll between the first and the second position.

The shifting means comprise electromagnet means energizable in one and an opposite direction and mechanically connected to said counter roll for shifting the same between said first and said second position depending on the direction of energizing the electromagnet means. Each of the guide rolls is rotatably mounted on one end of a lever insulated therefrom, and the other end of said lever is tiltably mounted on a support, and including biasing means cooperating with each lever for pressing the latter against the respective wire. The electrical control circuit further includes grounded contacts respectively engaging the wire portions between the respective advancing roll and the corresponding guide roll to an electric network, a pair of relay means, one connected in circuit with one of said guide rolls and said electromagnet means for energizing the latter in said one direction when said one relay means is energized and the other connected in circuit with the other of said guide rolls and said electromagnet means for energizing the latter in said other direction when said other relay means is energized, and means for deenergizing the respective relay means when one of said wire supply means runs out of wire or when one of the wire feed means is interrupted. The deenergizing means comprises a pair of switches respectively engaging the lever of the one and that of the other guide roll and opening upon tilting of the respective lever. The arrangement includes further a pair of control lights respectively connected in circuit with the nozzles.

The apparatus according to the present invention has especially the advantage that during the time of removal of the wire end from the exhausted reel, the wire from the new reel is without interruption advanced. The removal of the wire end from the exhausted reel and the insertion of the wire from the other reel has to occur only before start of the renewed wire feeding. An interruption of a continuous stapling of the wire is therefore not necessary any longer.

Since the wire is used as electric conductor, additional mechanisms for quick and positive switching over of the wire feed in the form of pendulating levers or rollers as necessary in the known construction are therefore not required with the construction of the present invention.

The switchover to the next wire reel occurs not only after exhaustion of the wire at one reel or breaking of the wire, but also by means of the tiltable guide rolls at an increase of the tension in the respective wire when feeding of the wire from the one supply reel is stopped due to blocking of the wire for any reason whatsoever.

The wire guide nozzles and the various rolls are dimensioned in such a manner that they may receive wires of various thickness and properly advance the same.

The novel features which are considered characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
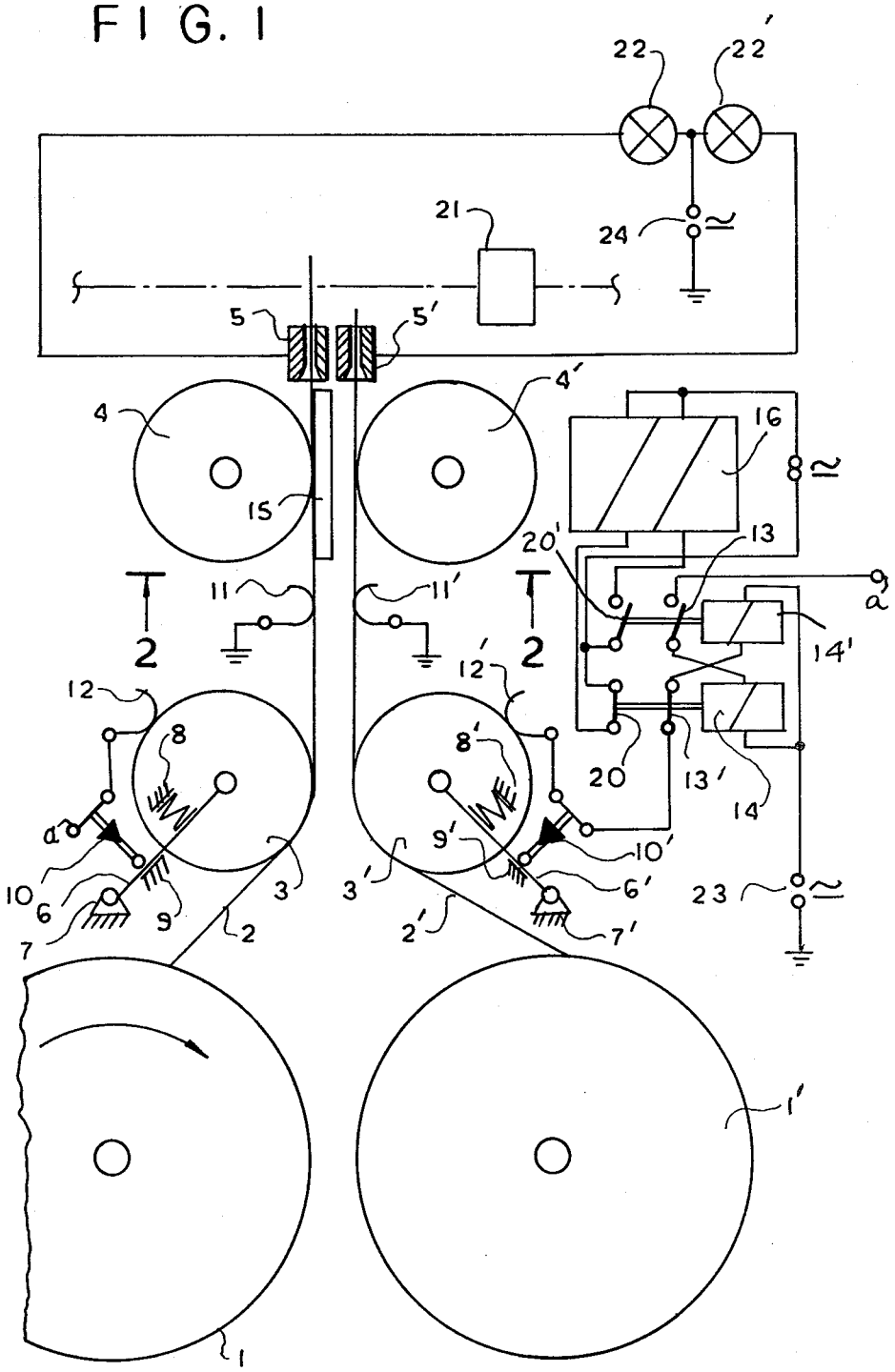
FIG. 1 is a schematic front view of the continuous wire feed arrangement of the present invention.

The continuous wire feed arrangement according to the present invention comprises, as shown in FIG. 1, two wire supply reels 1 and 1' from which the wires 2 and 2' are guided over insulated guide rolls 3 and 3' of electrically conductive material onto driven wire advancing rolls 4 and 4' into electrically conductive but insulated wire guide nozzles 5 and 5'. The wire 2 is shown in FIG. 1 in working position, and the wire 2' in position of readiness.

The guide rolls 3 and 3' are respectively turnably mounted at one of the ends of levers 6 and 6' of electrically non-conducive material, which in turn are tiltably mounted at the other end thereof in bearings 7 and 7'. The levers 6 and 6' are respectively pressed by springs 8 and 8'against stops 9 and 9'. The tiltable levers 6 and 6' are in contact with switches 10 and 10', respectively. Grounded contacts 11 and 11' respectively engage the wires 2 and 2' intermediate the guide rolls 3, 3' and the driven wire advancing rolls 4 and 4'. Contacts 12, 12' respectively connected in circuit with the switches 10 and 10' engage the guide rolls 3 and 3'. The switch 10 is connected in circuit over a switch 13 of a relay 14' with the relay 14 (it is to be understood that the point a of the switch 10 is connected to the point a in circuit with the switch 13) and the switch 10' may be connected in circuit over the switch 13' with the relay 14 so that alternately a circuit may be closed from the contact 11 over the wire 2, the guide roll 3, contact 12, switch 10, switch 13 to the relay 14 or from the contact 11' over the wire 2', guide roll 3', contact 12', switch 10', switch 13' to the relay 14'. A source of electrical energy 23 is connected in circuit with the two relays 14 and 14'.

Figure 2:
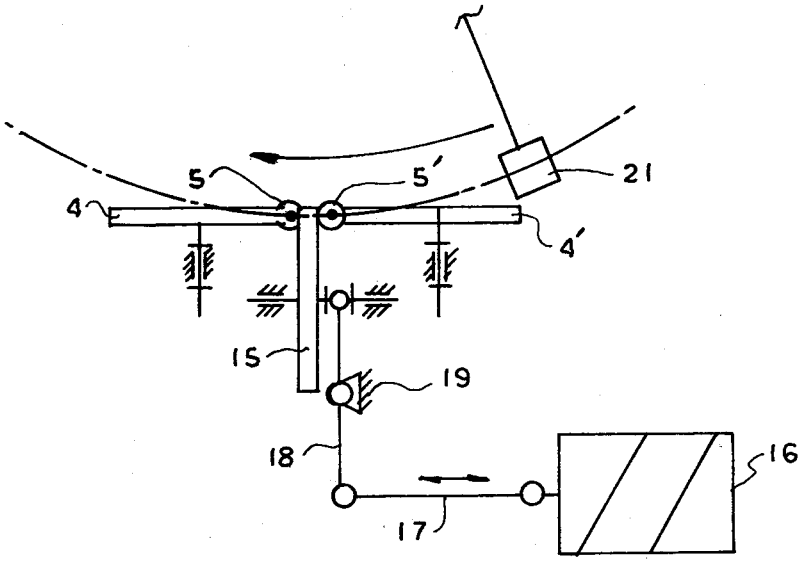
FIG. 2 is a section taken along line II—II.

A counter roll 15 is axially movably arranged between the wire advancing rolls 4 and 4'. The two wire advancing rolls 4 and 4', as well as the counter roll 15, are driven by means not shown in the drawing. The counter roll 15 is rotatable about an axis which is normal to the axes of the wire advancing rolls 4 and 4'. As best shown in FIG. 2, the counter roll 15 is connected by means of a connecting rod 17 and a double-armed lever 18 tiltably mounted intermediate its ends on a bearing 19 with a push-pull electromagnet 16. The magnet 16 is energized in the one or the other direction over the switches 20 or 20'. The wire guide nozzles 5 and 5' are arranged along the path of movement of the wires to a schematically illustrated cutting and transfer device 21 of known construction, not forming part of the present invention, which cuts the wires fed thereto into pieces and transfers the cut wire pieces to a non-illustrated stapling machine. The wire guide nozzles 5, which are, as mentioned before, insulated from the ground, are connected in circuit with two control lights 22, 22' which are in turn connected to a source of electrical energy 24 so that contact of one of the wires 2 or 2' with the respective guide nozzle 5 or 5' may be indicated by the control lights 22 or 22'.

If, as illustrated in FIG. 1, the wire 2 is advanced through the nozzle 5, a circuit is closed between the contact 11 over the wire 2, guide roll 3, contact 12, switch 10, switch 13 to the relay 14. The relay 14 is thus energized, closing thereby the switch 20 connected thereto which in turn energizes the magnet 16 in one direction. The magnet 16 thus pulls the connecting rod 17 so that the double-armed lever 18 pushes the counter roll 15 against the wire advancing roll 4 so that the wire 2 will be advanced through the nozzle 5 into the path of the cutting and transfer device 21. If the transport of the wire 2 over the guide roll 3 is finished, or interrupted by break of the wire 2, then the mentioned circuit will be likewise interrupted. The relay 14 is thereby deenergized, which causes the switch 13' to close, and the switch 20 to open. Closing of the switch 13' causes energizing of the relay 14', so that the switch 13 connected thereto will be opened and the switch 20' will be closed, provided that the wire 2' is in the position as shown in FIG. 1. This switch position will energize the magnet 16 in the opposite direction so that the counter roll 15 will be pressed against the wire advancing roll 4' to thereby advance the wire 2'.

The residual piece of the wire 2 may now be removed, a new supply reel 1 be put in place, and the new wire be placed in position of readiness.

The switchover of the wire advance from the wire reel 1 to the wire reel 1', and vice versa, is also possible by stopping of the resepctive wire, for instance when the same becomes entangled. If this happens, the tension of the respective wire will increase, and the guide roll 3 or 3' is tilted outwardly, so that the switch 10' or 10 interrupts the respective circuit. All further steps will then occur as described above.

It will be understood that each of the elements described above, or two or more together, may also find a useful application in other types of continuous wire feed arrangements differing from the types described above.

While the invention has been illustrated and described as embodied in a continuous wire feed arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A continuous wire feed arrangement for feeding wire to a stapling apparatus or the like, comprising two wire supply means; two wire guide nozzles respectively arranged along paths leading from the respective wire supply means to a wire cutting and transmitting device; wire feed means positioned between said wire supply and said guide nozzles in said paths and operative for respectively transporting the wires from the wire supply means through and beyond the respective means; and electrical control circuit means including two guide rolls of electrically conductive material and insulated from the ground each arranged between the respective wire supply means and said wire feed means cooperating with said wire feed means so that, upon interruption of wire feed from one of said wire supply means to one of said nozzles, said control circuit means cause transport of wire from the other supply means to and beyond the other of said nozzles to thus produce a continuous wire feed.

2. A continuous wire feed arrangement as defined in claim 1, wherein each of said wire supply means comprises a wire reel.

3. A continuous wire feed arrangement as defined in claim 2, wherein said two nozzles are arranged substantially parallel and adjacent each other, wherein said wire feed means comprises a pair of transversely spaced driven wire advancing rolls respectively engaging the wires between the respective guide roll and the respective nozzle and a driven counter roll located in the region of said pair of advancing rolls between said wires and axially shiftable between a first position pressing one of said wires against the periphery of one of said advancing rolls so as to feed said one wire and a second position pressing the other wire against the other of said advancing rolls to feed the other wire, and electromechanical shifting means connected to said control circuit means for shifting said counter roll between said first and said second position.

4. A continuous wire feed arrangement as defined in claim 3, wherein said wire advancing rolls are arranged for rotation about parallel axes extending substantially normal to the wire portions passing between said guide rolls and said nozzles and wherein said counter roll is arranged for rotation about an axis normal to the axes of the advancing rolls.

5. A continuous wire feed arrangement as defined in claim 4, wherein said shifting means comprise electromagnet means energizable in one and in an opposite direction and mechanically connected to said counter roll by a lever mounted on a bearing for shifting the counter roll between said first and said second position depending on the direction of energizing said electromagnet means.

6. A continuous wire feed arrangement as defined in claim 5, each of said guide rolls being turnably mounted on one end of said lever which is insulated from the ground, said bearing tiltably mounting the other end of said lever, said control circuit means further including grounded contacts respectively engaging the wire portions between the respective advancing roll and the corresponding guide roll, a pair of relay means one connected in circuit with one of said guide rolls and said electromagnet means for energizing the latter in one direction when said one relay means is energized and the other connected in circuit with the other of said guide rolls and said electromagnet means for energizing the latter in said opposite direction when said other relay means is energized, and means for deenergizing the respective relay means when one of the wire reels runs out of wire, when one of the wires breaks, or when the tension in one of the wires increases due to entanglement of said one wire so that the guide roll engaging the wire will tilt.

7. A continuous wire feed arrangement as defined in claim 6, wherein said deenergizing means comprises a pair of switches respectively engaging the levers on which said guide rolls are mounted and opening on tilting of the respective lever.

8. A continuous wire feed arrangement as defined in claim 1, and including a pair of control lights respectively connected in circuit with said nozzles.

* * * * *